US005815183A

United States Patent [19]

Sasaki

[11] Patent Number: 5,815,183

[45] Date of Patent: Sep. 29, 1998

[54] INK CARTRIDGE HAVING A REABSORBATION CAPABILITY FOR FREE INK

[75] Inventor: Toyonori Sasaki, Anjo, Japan

[73] Assignee: Brother Kogyo Kabushiki Kaisha, Nagoya, Japan

[21] Appl. No.: 636,473

[22] Filed: Apr. 23, 1996

[30] Foreign Application Priority Data

Jul. 12, 1995 [JP] Japan ..... 7-200570

[51] Int. Cl.[6] ..... B41J 2/175

[52] U.S. Cl. ..... 347/86; 347/87

[58] Field of Search ..... 347/86, 87; 346/140 R

[56] References Cited

U.S. PATENT DOCUMENTS 5,182,579 1/1993 Haruta et al. ..... 346/140 R
5,512,925 4/1996 Ohashi ..... 347/86
5,515,090 5/1996 Almgren et al. ..... 347/76
5,552,816 9/1996 Oda et al. ..... 347/86

FOREIGN PATENT DOCUMENTS 2100977 1/1994 Canada .

*Primary Examiner*—Peter S. Wong
*Assistant Examiner*—Bao Q. Vu
*Attorney, Agent, or Firm*—Oliff & Berridge, PLC

[57] ABSTRACT

A head holder has an ink supply member projecting therefrom which serves to supply ink to a recording head. An ink cartridge is mounted on the head holder by inserting the ink supply member into the ink supply port. A capillary force generator made up of a plurality of small grooves is provided in an area extending from the lower end portion of a side wall portion in which the ink supply port is formed, to a portion adjacent to the ink absorber on the inner surface of the ink cartridge. When the cartridge is loaded, the ink supply member is pressed against the ink absorber, and ink which oozes or is forced from the compression of the ink absorber is trapped in a space at the lower side. However, the trapped ink is guided to and absorbed again by the ink absorber through the capillary action of the small grooves.

17 Claims, 10 Drawing Sheets

INK CARTRIDGE HAVING A REABSORBATION CAPABILITY FOR FREE INK

BACKGROUND OF THE INVENTION

1. Field of the Invention

The invention relates to an ink cartridge for supplying ink to a recording head for jetting the ink, and particularly to an ink cartridge provided with a capillary force generator for guiding to an ink absorber the ink which is oozed from an ink absorber, compressed when an ink supply member is inserted into a cartridge body, using capillary action.

2. Description of Related Art

In general, an ink jet recording apparatus is provided with a recording mechanism for jetting ink, supplied from an ink cartridge, in a horizontal direction, a vertical direction or a slant direction to record information on a sheet, and a driving mechanism for moving the recording mechanism by means of a carriage in a recording direction. The ink cartridge serves to supply ink to a recording head. It comprises a cartridge body having an ink supply port and a spongy ink absorber in which the ink is absorbed, the ink absorber being accommodated in the cartridge body. One known type of ink cartridge which can be detachably mounted on a head holder from a vertical direction, a horizontal direction or slant direction in accordance with a mount position of the recording head on the head holder.

The head holder is provided with a recording head for jetting ink and an ink supply member for introducing the ink to the recording head. When the ink cartridge is mounted on the head holder, the tip portion of the ink supply member is inserted into the ink supply port, and the ink of the ink cartridge is supplied through the ink supply member into the recording head.

When the tip portion of the ink supply member is inserted into the ink supply port of the cartridge body as described above, a portion of the ink absorber which is located at the ink supply port side is compressed by the tip portion of the ink supply member, so that the ink which is absorbed by the ink absorber is forced from the ink absorber due to the compression.

For example, there is known such a type of recording mechanism 100 (FIGS. 12–13) that a recording head 103 is secured to an obliquely lower side of a head holder 101. An ink cartridge 110 is detachably mounted on a head holder 101 in a slant direction as shown in FIGS. 12 and 13. According to this type of recording mechanism 100, when the tip portion of an ink supply member 102 is inserted into an ink supply port 112, as shown in FIG. 12, the ink absorber 113 is compressed by the tip portion of the ink supply member 112, and the ink in the ink absorber 113 is forced from the ink absorber 113. At this time, the oozed, or free, ink is trapped in a space Z which occurs through the compression of the ink absorber 113, and the trapped ink is gradually absorbed into the ink absorber 113 from a portion nearest to the ink absorber 113.

Further, there is also known a type of recording mechanism 120 (FIGS. 14–15) where a recording head 123 is secured to the lower side of a head holder 121. An ink cartridge 130 is detachably mounted on the head holder 121 from a vertical direction as shown in FIGS. 14 and 15. In this type of recording mechanism 120, when or while the ink cartridge 130 is mounted on the head holder 121, a cylindrical seal member 132 having a pair of upper and lower ring-shaped seal portions 132A which extend inwardly is fixedly inserted into the ink supply port 131A to prevent the ink from leaking from the ink supply port 131A of the cartridge body 131. When the ink cartridge 130 thus structured is mounted on the head holder 121, the ink forced from the ink absorber 135, which is compressed upon insertion of the ink supply member 122, is trapped in an area extending from the upper end portion of the upper seal portion 132A which is elastically deformed in a upwardly curved shape to the lower side as shown in FIG. 14. The trapped ink is gradually absorbed by the ink absorber 135 in the same manner as described above.

The conventional ink jet recording apparatus as described above is disclosed in Canadian Patent Application No. 2,100,977 (Japanese Laid-open Patent Publication No. Hei-6-40043).

The two types of recording mechanisms as described above have the following problems.

With respect to the ink cartridge 110 which is detachably mounted on the head holder 10 from the slant direction, if the ink trapped at the lower end portion of the space Z in the cartridge body 111 does not reach the ink absorber 113, the ink is not absorbed by the ink absorber 113 and thus the ink trapped at the lower end portion of the space Z is never used. Therefore, all the ink in the cartridge body 131 cannot be effectively used.

With respect to the ink cartridge 130 which is detachably mounted from the head holder 121 from the vertical direction, it needs a remarkably long time for all the ink which is forced or oozed from the ink absorber 135 to be reabsorbed by the ink absorber 135. Thus, the ink which is not reabsorbed by the ink absorber 135 may leak from the ink supply port 131A of the cartridge body 131, as shown in FIG. 15, when the ink cartridge 130 is detached from the head holder 121.

SUMMARY OF THE INVENTION

An object of the invention is to provide an ink cartridge which can guide to an ink absorber the ink that oozes or is forced from the ink absorber which is compressed upon insertion of an ink supply member to promote absorption of the ink by the ink absorber.

According to the invention, an ink cartridge which is freely detachably mounted on a head holder, having an ink supply member which projects from the head holder and serves to supply ink to a recording head, includes a cartridge body containing an ink absorber in which the ink is absorbed, an ink supply port which is provided to the cartridge body and through which the tip portion of the ink supply member is inserted to supply the ink of the ink absorber to the ink supply member, and a capillary force generator which is provided in the cartridge body and serves to guide the ink oozing or forced from the ink absorber when compressed by the insertion of the ink supply member to the ink absorber by capillary action.

In the ink cartridge as described above, the capillary force generator is formed in an area extending from the ink supply port side to a portion adjacent to the ink absorber on a bottom wall portion of the cartridge body.

In the ink cartridge as described above, the ink supply port is formed on a side wall portion of the cartridge body and the capillary force generator is formed in an area extending from the lower end portion of the side wall portion to the portion adjacent to the ink absorber on the bottom wall portion of the cartridge body.

Further, in the ink cartridge of the invention, the capillary force generator comprises plural small grooves extending from the ink supply port side to the portion adjacent to the ink absorber.

According to the ink cartridge of the invention, the cartridge body is provided with the capillary force generator by which the ink that oozes or is forced from the ink absorber which it is compressed by the insertion of the ink supply member is guided or returned to the ink absorber by the capillary action. Therefore, the ink which oozes from the ink absorber is withdrawn into the ink absorber through the capillary force generator, and substantially all the ink stocked in the cartridge body can be effectively used.

Since substantially all the ink can be withdrawn into the ink absorber, the ink can be prevented from leaking from the ink supply port of the cartridge body when the ink cartridge is detached from the head holder.

Further, according to the ink cartridge of the invention, the capillary force generator is formed over the area extending from the ink supply port side to the portion adjacent to the ink absorber on the bottom wall portion of the cartridge body. Therefore, the ink which is trapped at the ink supply port side portion of the bottom wall portion of the cartridge body can be surely guided, i.e., returned to the ink absorber by the capillary force generator.

Still further, according to the ink cartridge of the invention, the ink supply port is formed on the side wall portion of the cartridge body, and the capillary force generator is formed over the area extending from the lower end portion of the side wall to the portion adjacent to the ink absorber on the bottom wall portion of the cartridge body. Therefore, the ink which is trapped at the lower end portion of the side wall portion can be surely guided to the ink absorber by the capillary force generator.

Still further, according to the ink cartridge of the invention, the capillary force generator comprises plural grooves which extend from the ink supply port side to the portion adjacent to the ink absorber. Therefore, the capillary force generator has a simple structure and, thus, it can be manufactured at a low cost. In addition, the capillary action of the capillary force generator can be surely obtained.

BRIEF DESCRIPTION OF THE DRAWINGS

A preferred embodiment of the invention will be described in detail with reference to the following figures wherein.

DETAIL DESCRIPTION OF THE PREFERRED EMBODIMENTS

Preferred embodiments according to the invention will be described hereunder with reference to the accompanying drawings.

A first embodiment relates to a case where the present invention is applied to an ink cartridge which is detachably mounted at an oblique angle on a head holder of a recording mechanism provided to the ink jet recording apparatus.

Figure 1:
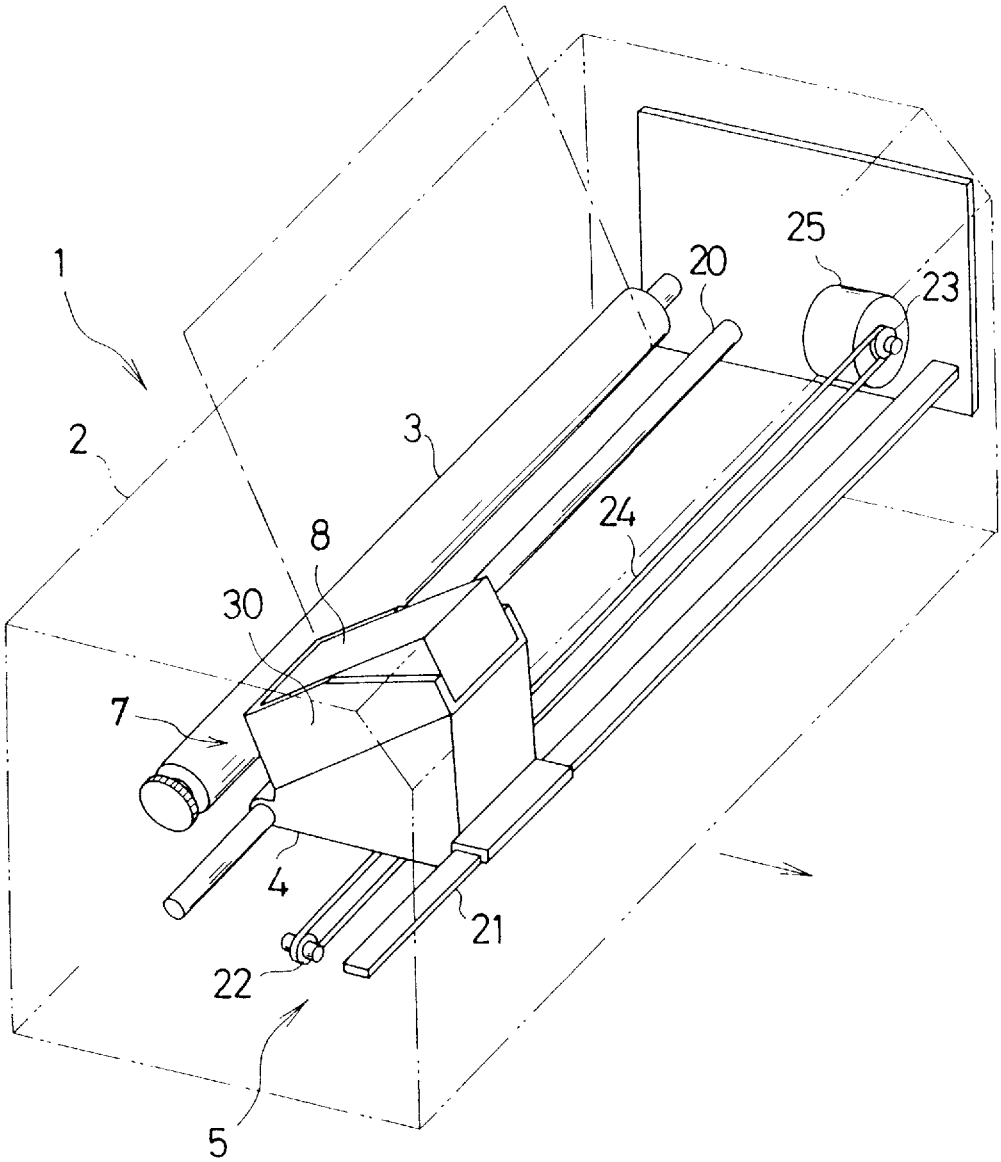
FIG. 1 is a schematic diagram showing an ink jet recording apparatus according to an embodiment of the invention.

As shown in FIG. 1, in a housing 2 of an ink jet recording apparatus 1, a platen 3 for feeding a sheet P, a carriage driving mechanism 5 for driving a carriage 4, and a recording mechanism 7 for jetting ink stocked in the ink cartridge 8 through ink jet nozzles onto the sheet P to form an image on the sheet P are provided.

Figure 2:
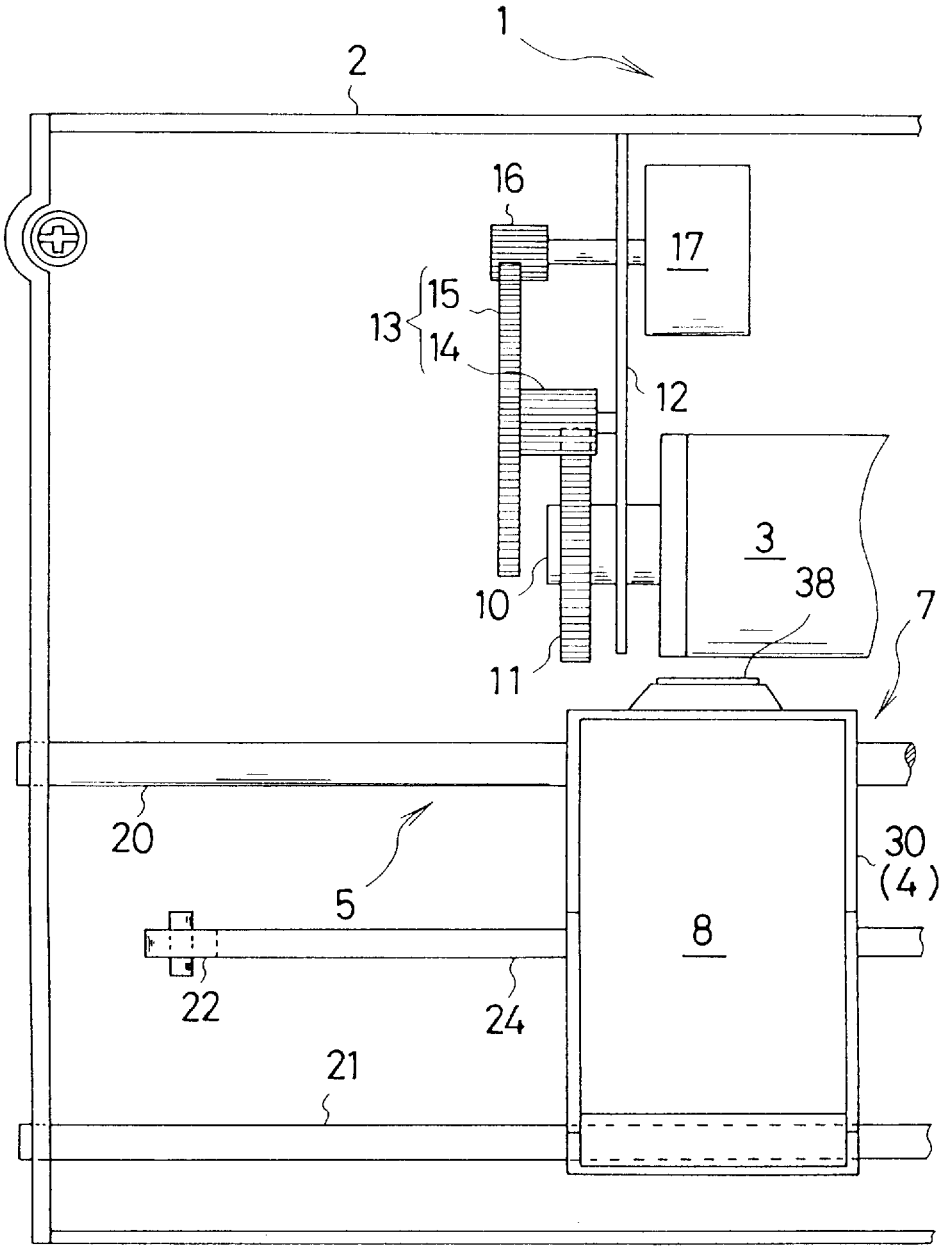
FIG. 2 is a enlarged plan view showing the ink jet recording apparatus of FIG. 1.

Further, as shown in FIG. 2, the platen 3 is disposed in a right-and-left direction (i.e., horizontal direction when viewed from the front). The left end portion of a platen shaft 10 of the platen 3 is pivotally supported by a side wall plate, and a platen gear 11 is secured to the left portion of the platen shaft 10. A composite gear 13, which comprises a first driven gear 14 engaged with the platen gear 11, and a second driven gear 15, is rotatably and pivotally supported by the side wall plate 12, and a feed motor 17 is secured to a driving gear 16 which is engaged with the second driven gear 15. Accordingly, when the feed motor 17 is driven in a predetermined rotational direction to rotate the driving gear 16, the platen 3 is driven in a predetermined sheet feed direction through the composite gear 13 and the platen gear 11.

As shown in FIGS. 1 and 2, the carriage 4 is designed in a substantially plate shape and it is disposed horizontally. The rear and front end portions of the carriage 4 are supported by a guide rod 20 disposed in parallel to the platen and by a guide rail 21 disposed in parallel to the guide rod 20 so the carriage A is freely movable in the right-and-left direction. A driven pulley 22 is rotatably and pivotally mounted on a frame (not shown) at the left side of the movable range of the carriage 4, and a driving pulley 23, which is secured to a driving shaft of the carriage driving motor 25, is provided at the right end side of the movable range of the carriage 4. An endless timing belt 24 is suspended between the pulleys 22 and 23. Upon rotation of the carriage driving motor 25, the carriage 4 is moved in a recording direction (right direction) and a non-recording direction (left direction).

As shown in FIGS. 1 to 3 and FIG. 5, the recording mechanism 7 is provided with a head holder 30 secured on the carriage 4, a recording head 38 secured at the obliquely rear side of the head holder 30, an ink supply member 33 for supplying ink to the recording head 38, and an ink cartridge 8 which is detachably mounted on the head holder 30 from the slant direction. The recording head 38 is fixed to the head holder 30 through the ink supply member 33. The ink supply member 33 comprises a hold portion 34 for fixedly holding the recording head 38, and a shaft portion 35 in which an ink supply passage 35A is formed. The hold portion 34 is fixed to the rear portion of a partition plate 31 of the head holder 30, and the shaft portion 35 is designed so that it extends so as to penetrate through a through hole 31A formed in the partition plate 31 and its tip portion projects from the partition plate 31 into the head holder 30.

Figure 3:
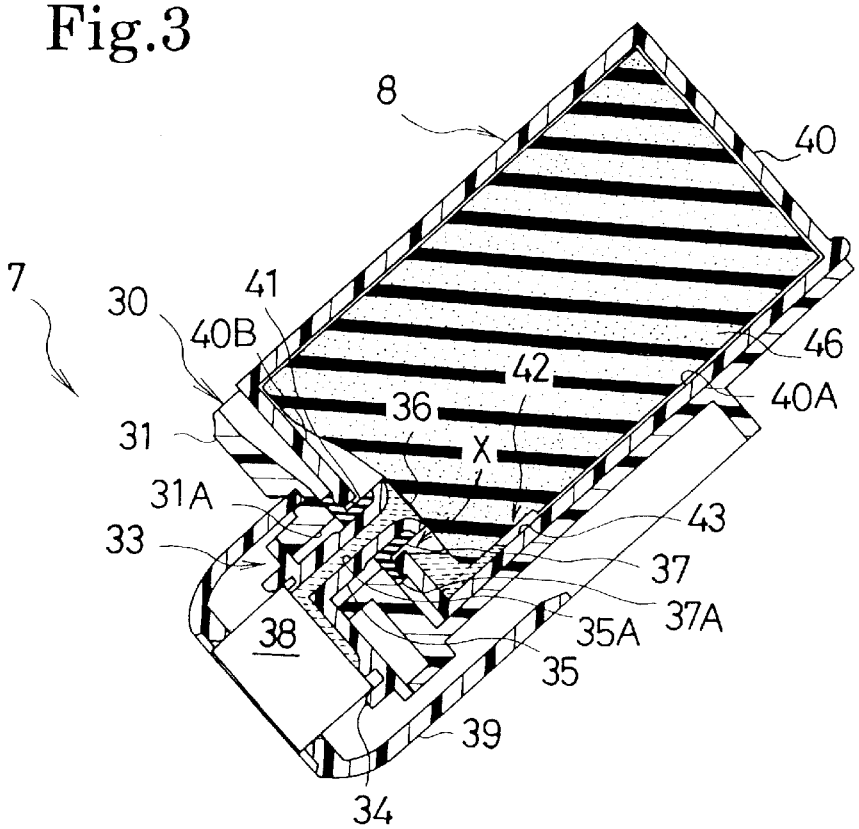
FIG. 3 is a cross-sectional view of a recording mechanism, and shows ink that has oozed from an ink absorber is trapped at the lower end portion of a space occurring due to compression of the ink absorber.
Figure 5:
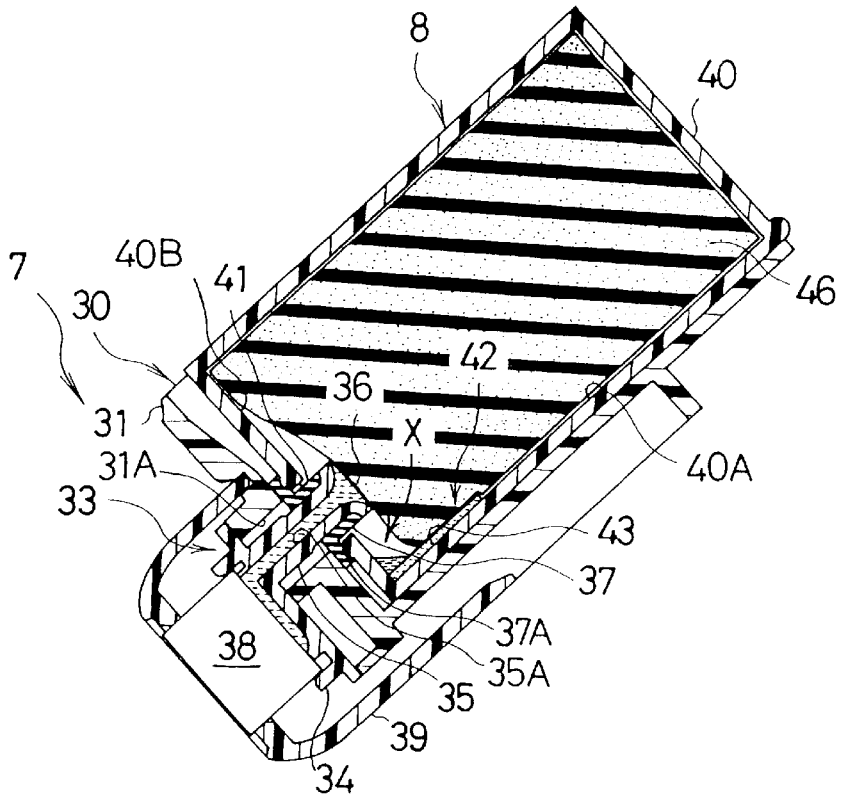
FIG. 5 is a cross-sectional view showing the recording mechanism and shows the ink that has oozed from the ink absorber and been trapped at the lower end portion of the space occurring due to the compression of the ink absorber, is guided to and absorbed into the ink absorber by the capillary force generator.

A seal member 37 having a flange-type press portion 37A is fixedly mounted on the outer periphery of the tip portion of the shaft portion 35. As shown in FIGS. 3 and 5, when the ink cartridge 8 is mounted on the head holder 30, the outer peripheral portion of the ink supply port 41 of the cartridge body 40 of the ink cartridge 8 is pressed against the press portion 37A to prevent the ink in the cartridge body 40 from leaking from the ink supply port 41. Reference numeral 36 represents a filter which is provided to the tip portion of the ink supply passage 35A of the ink supply member 33, and reference numeral 39 represents a cap-shaped head guide for fixedly holding the tip end portion of the recording head 38.

Next, the ink cartridge 8, which is detachably mounted on the head holder 30 from the slant direction, will be described. As shown in FIGS. 3 to 6, the ink cartridge 8 comprises a box-shaped cartridge body 40 and an ink absorber 46 which is accommodated in the cartridge body 40 and in which ink is absorbed, for example, the ink absorber 46 is formed of urethane foam of polyether group. An ink supply port 41 through which the tip end portion of the ink supply member 33 is insertable is formed in the cartridge body 40.

Figure 4:
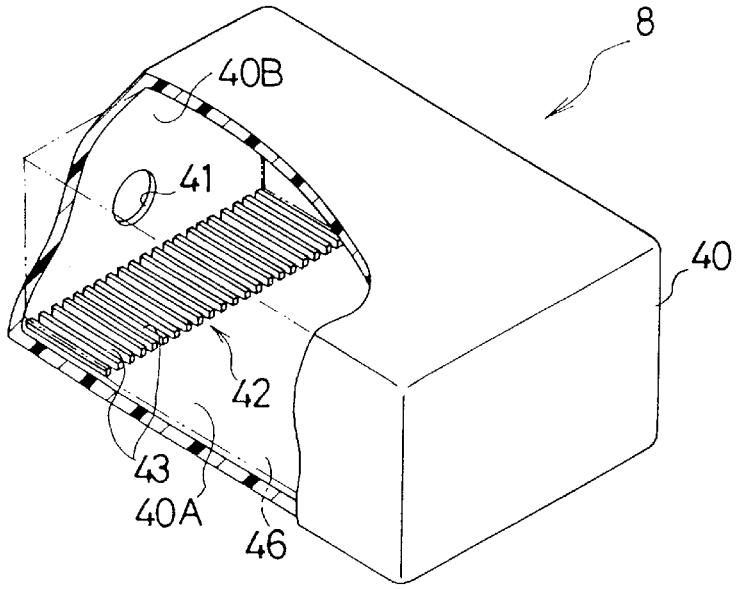
FIG. 4 is a partially cut-away, perspective view showing an ink cartridge.

On the bottom wall portion 40A in the cartridge body 40 is provided the capillary force generator 42 which is disposed over an area extending from the lower end portion of the side wall portion 40B in which the ink supply port 41 is opened, to a portion of the bottom wall portion 40A which is adjacent to and underlies the ink absorber 46. As described above, when the ink supply member 33 is inserted into the ink cartridge body 40, ink oozes or is forced from the ink absorber 46 due to compression of the ink absorber 46. The capillary force generator 42 serves to guide the ink that oozes, or is freed, from the ink absorber 46 back into the ink absorber 46 again by capillary action. The capillary force generator 42 comprises a plurality of small grooves 43 which are formed so as to extend, i.e., have a general orientation, from the side wall portion 40B to a portion adjacent to the ink absorber 46 as shown in FIGS. 3 and 4.

Figure 6:
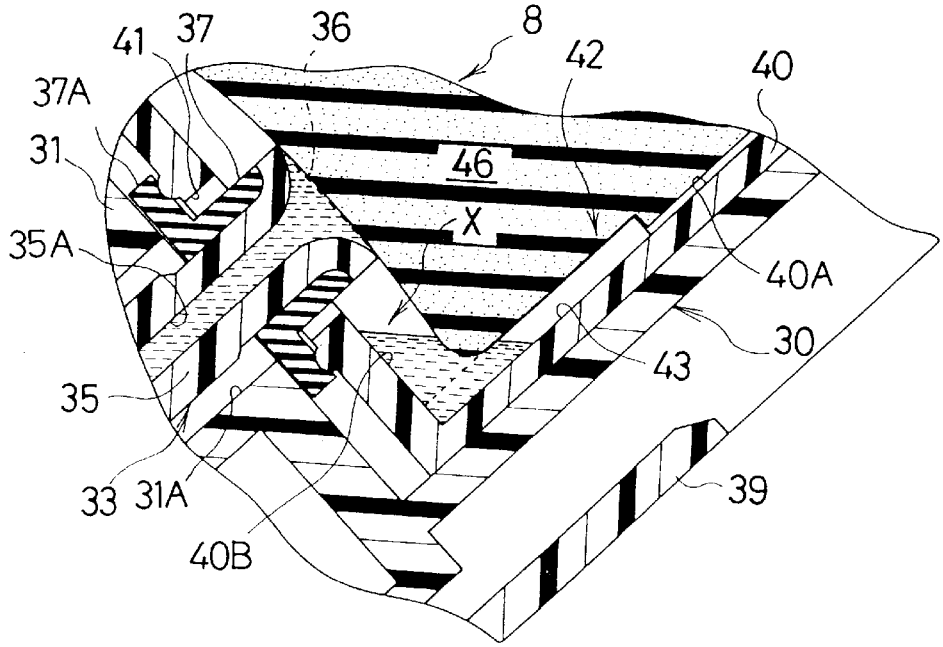
FIG. 6 is an enlarged view showing a main part of FIG. 5.

As shown in FIG. 3, when the ink cartridge 8 is mounted on the head holder 30, the ink supply member 33 is inserted into the ink supply port 41, and the ink absorber 46 is compressed by the tip portion of the ink supply member 33. The compression of the ink absorber 46 causes the ink to ooze from the ink absorber 46. The oozed ink is trapped in a space X which occurs due to the compression of the ink absorber 46. The trapped ink is gradually reabsorbed by the ink absorber 46. In this case, even when the trapped ink does not reach the ink absorber 46, the ink is forceably guided to the ink absorber 46 by the capillary force generator 42 as shown in FIGS. 5 and 6, and is reabsorbed by the ink absorber 46.

That is, according to the ink cartridge 8, the cartridge body 40 is provided therein with the capillary force generator 42 for guiding the ink that oozes from the ink absorber 46 back to the ink absorber 46 by capillary action. Therefore, the ink which oozes from the ink absorber 46 due to the compression of the ink absorber 46 and, thus, is trapped in the space X, can be withdrawn through the capillary force generator 42 to the ink absorber 46 again and no ink is wasted. Accordingly, substantially all the ink stocked in the cartridge body 40 can be effectively used.

In addition, since the capillary force generator 42 is formed of the plurality of small grooves 43 which extend from the lower end portion of the side wall portion 40B to the portion adjacent to the ink absorber 46 on the bottom wall portion 40A of the cartridge body 40, the capillary force generator 42 has a simple structure and the ink cartridge 8 can be manufactured at a low cost.

The ink which is guided to the ink absorber 46 by the capillary force generator 42 is absorbed by the whole portion of the ink absorber 46 which is adjacent to the capillary force generator 42 so that the withdrawal efficiency of the ink oozed from the ink absorber 46 can be improved. In addition, when the ink cartridge B is mounted on the head holder 30, the ink can be absorbed by the ink absorber 46 with high efficiency even if the amount of ink that oozes or is forced from the ink absorber 46 and is trapped in the space X of the cartridge body 40 is sufficient to reach the ink supply port 41. Thus, the ink can be surely prevented from leaking from the ink supply port 41 when the ink cartridge 8 is mounted on or detached from the head holder 30.

Not shown, but readily apparent, the capillary force generator 42 may be provided over the whole area of the bottom surface 40A. The ink cartridge 8 as described above may also be the type of ink cartridge that is detachably mounted on the head holder from the horizontal direction. Further, when the invention is applied to a recording mechanism for jetting four kinds of color ink, the ink cartridge 8 may be each of such a slender type of four ink cartridges which are detachably mounted on the head holder of the recording mechanism, each filled with a different color ink (cyan, magenta, yellow, black) and having a smaller width than the ink cartridge 8 described above.

Next, a second embodiment of the ink cartridge of the invention will be described with reference to FIGS. 7–11.

Figure 7:
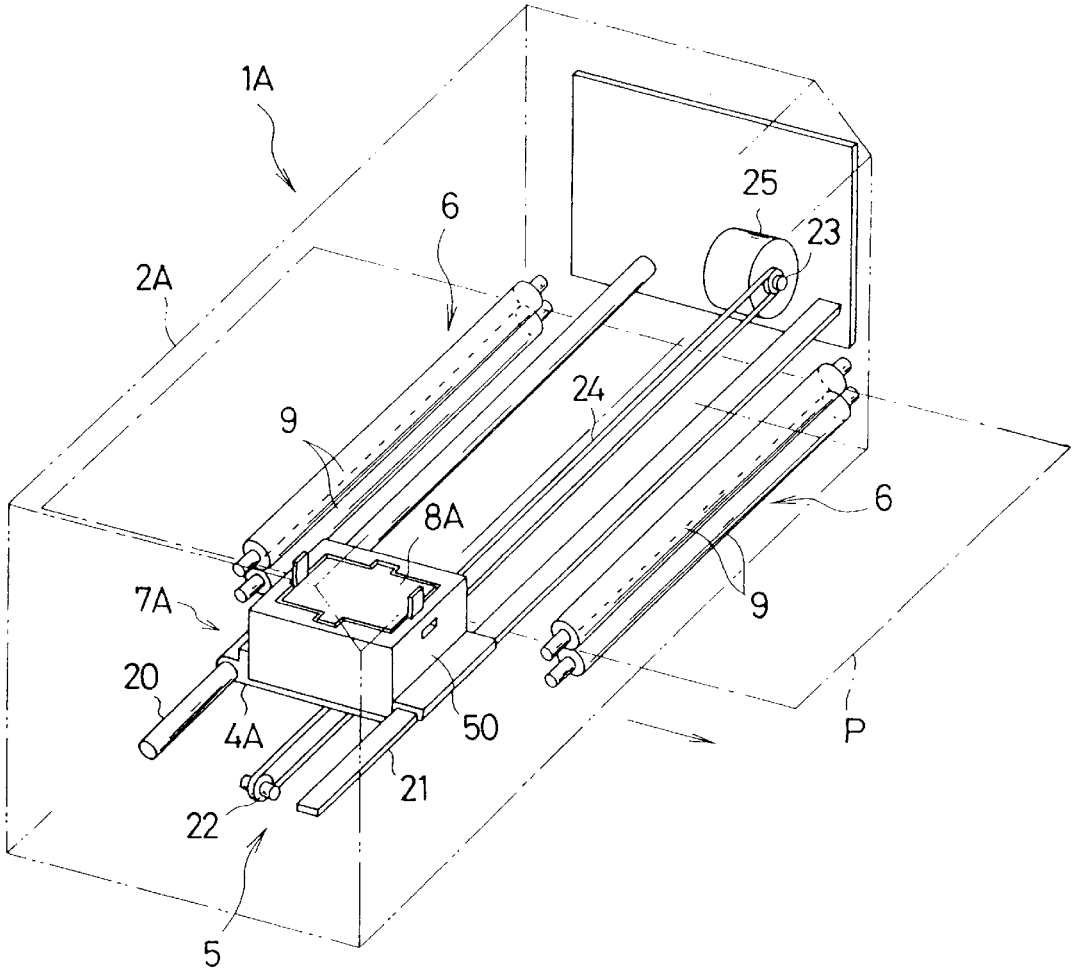
FIG. 7 is a schematic diagram showing an ink jet recording apparatus according to a second embodiment of the invention.

As shown in FIG. 7, in a housing 2A of an ink jet recording apparatus 1A a sheet feeding mechanism 6 for feeding a sheet P, a carriage driving mechanism 5 for driving a carriage 4A, and a recording mechanism 7A for jetting ink stocked in the ink cartridge 8A from plural nozzles of a recording head 57 to form an image on the sheet P are provided. The carriage driving mechanism 5 has basically the same structure as the first embodiment. Thus, the same elements are represented by the same reference numerals and their description is omitted.

In this embodiment, two sheet feeding mechanisms 6 are provided at the upstream and downstream sides of the carriage driving mechanism 5, respectively. Each sheet feeding mechanism 6 is provided with a pair of rollers comprising an upper and a lower sheet feeding roller 9 which are disposed so as to extend in the left-and-right direction. The pair of upper and lower sheet feeding rollers 9 are rotated in the opposite directions and at the same rotational speed by a driving motor (not shown), whereby the sheet P pinched by the paired upper and lower sheet feeding rollers 9 is fed in a predetermined sheet feeding direction.

Figure 8:
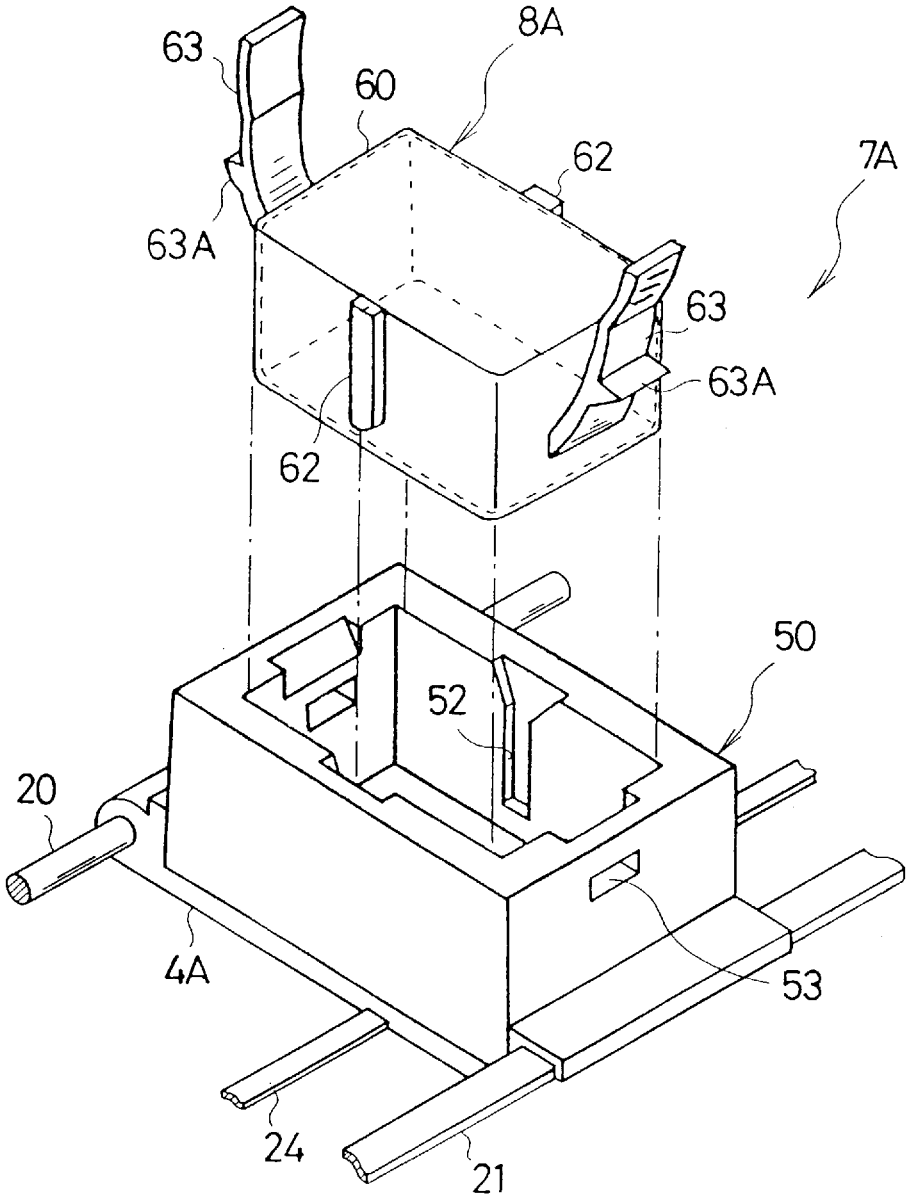
FIG. 8 is a perspective view showing the recording mechanism which is provided to the ink jet recording apparatus of the second embodiment.
Figure 9:
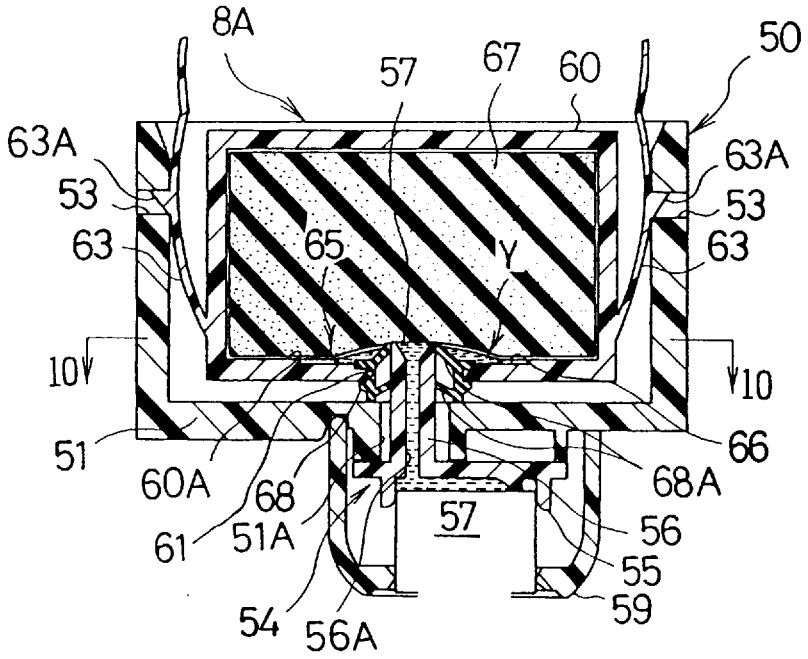
FIG. 9 is a cross-sectional view showing the recording mechanism, and shows ink that has oozed from the ink absorber is trapped in a space occurring due to the compression of the ink absorber.
Figure 11:
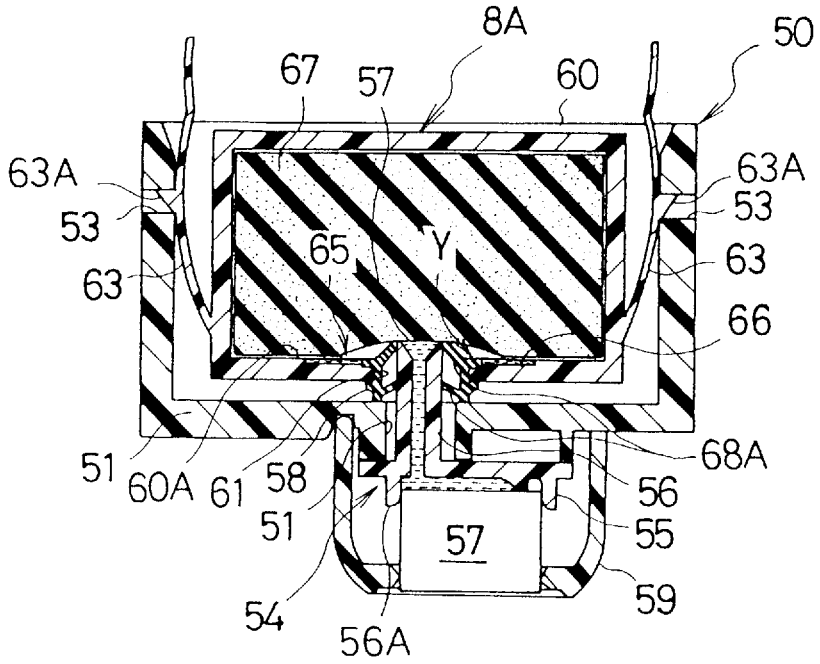
FIG. 11 is a cross-sectional view showing the recording mechanism, and shows the ink that has oozed from the ink absorber and is trapped in a space occurring due to the compression of the ink absorber is guided to and absorbed in the ink absorber by the capillary force generator.
Figure 12:
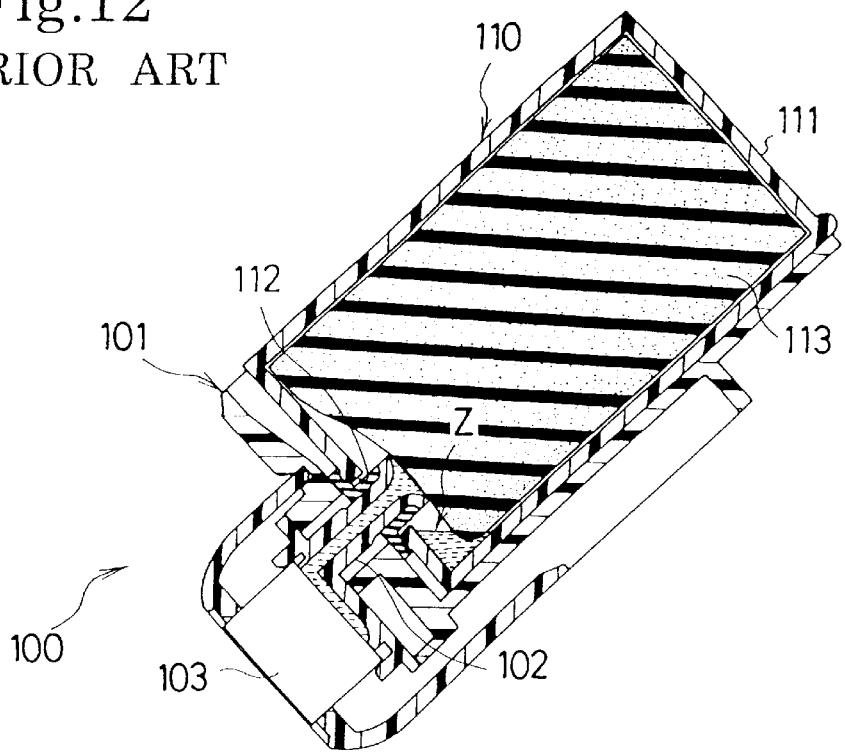
Fig.12 PRIOR ART
FIG. 12 is a cross-sectional view showing a conventional recording mechanism with the ink that has oozed from the ink absorber trapped at the lower end portion of the space occurring due to the compression of the ink absorber.
Figure 13:
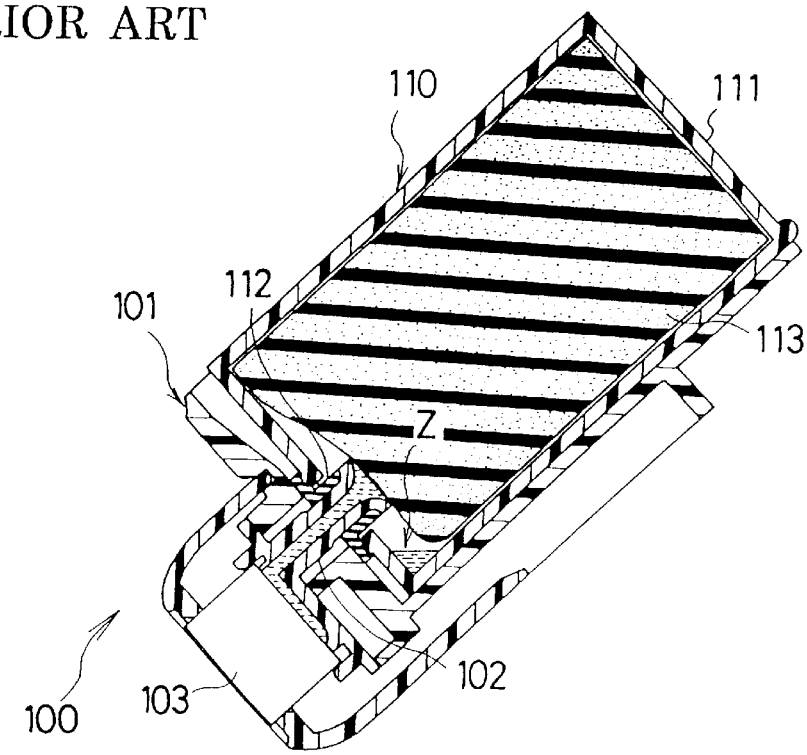
Fig.13 PRIOR ART
FIG. 13 is a cross-sectional view showing the recording mechanism and shows the ink that has oozed from the ink absorber and is trapped at the lower end portion of the space occurring due to the compression of the ink absorber is not absorbed by the ink absorber and is trapped in the space.
Figure 14:
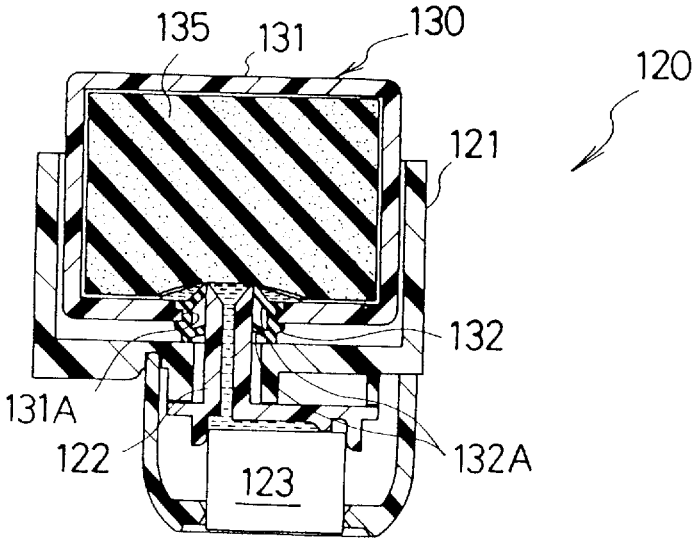
Fig.14 PRIOR ART
FIG. 14 is a cross-sectional view showing a second conventional recording mechanism and shows a state where ink that has oozed from the ink absorber is trapped in the vicinity of the ink supply port in the cartridge body.
Figure 15:
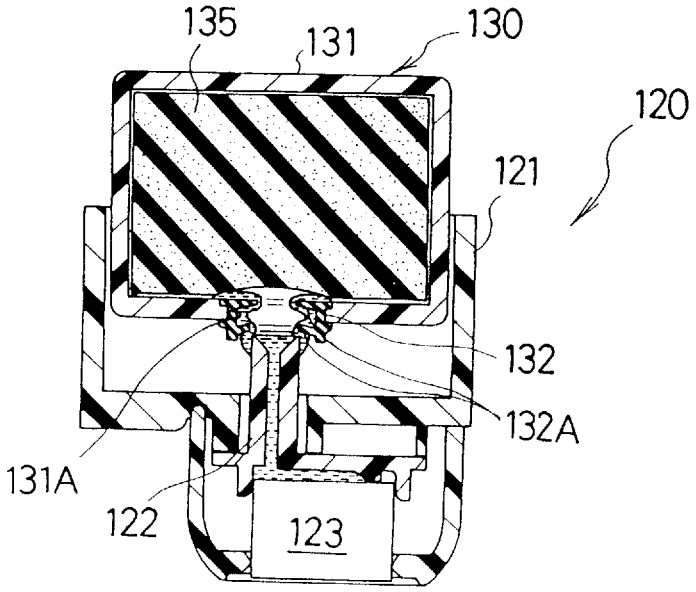
Fig.15 PRIOR ART
FIG. 15 is a cross-sectional view showing the recording mechanism and shows the ink that has oozed from the ink absorber and is trapped in the vicinity of the ink supply port in the cartridge body.

As shown in FIGS. 8, 9 and 11, the recording mechanism 7A is provided with a box-shaped head holder 50 secured on the carriage 4A, a recording head 57 is secured at the lower side of the head holder 50 with an ink supply member 54 for supplying ink to the recording head 57. An ink cartridge 8A is detachably mounted on the head holder 50 from the vertical direction. The recording head 57, which is fixed to the head holder 50 through the ink supply member 54, has a plurality of jetting nozzles (not shown) faced down. A guide groove 52 having an upper end portion which is formed more widely (i.e., a tapered upper end portion) is formed in the vertical direction on each of the right and left side walls in the head holder 50, and a hole portion 53 is formed on each of front and rear side walls of the head holder 50.

The ink supply member 54 comprises a hold portion 55 for fixedly holding the base end portion of the recording head 57 and a shaft portion 56 having an ink supply passage 56A formed therein. The hold portion 55 is fixed to the lower surface side of the bottom wall portion 51 of the head holder 50, and the shaft portion 56 is extended upwardly so as to penetrate through an insertion hole 51A formed on the bottom wall portion 51 and its tip portion is projected upwardly from the bottom wall portion 51. A filter 57 is provided at the tip portion of the ink supply passage 56A of the ink supply member 54 and a cap-shaped head guide 59 is for protecting the recording head 57 and fixedly holding the tip portion of the recording head 57.

Next, the ink cartridge 8A which is detachably mounted in the head holder 50 from the vertical direction will be described in detail.

As shown in FIGS. 8 to 11, the ink cartridge 8A includes a cartridge body 60, and an ink absorber 67, formed of urethane form of the polyether group, for example, which is accommodated in the cartridge body 60 and absorbs the ink. The cartridge body 60 is formed with an ink supply port 61 through which the tip portion of the ink supply member 54 is insertable, and a flange-shaped seal member 68 having a pair of seal portions 68A which extend inwardly is fixedly inserted in the ink supply port 61.

Further, provided on both the right and left outer surfaces of the cartridge body 60 are block-shaped guide portions 62 which are engageable with the guide grooves 52 formed on the head holder 50. Provided on both the front and rear outer surfaces of the cartridge body 60 are curved operation portions 63 which are formed integrally with the cartridge body 60 and extend upwardly from the lower portion of the cartridge body 60. Further, substantially on the center portions of the operation portions 63 are holding portions 63A which are engagedly insertable in the hole portions 53 of the head holder 50.

When the guide portions 62 of the cartridge body 60 are engaged with the guide grooves 52 of the head holder 50 to guide the ink cartridge 8A in the vertical direction and engagedly insert the ink cartridge 8A into the head holder 50, the holding portions 63A of the operation portions 63 are engagedly inserted into the hole portions 53 as shown in FIGS. 9 and 11, whereby a loading operation of the ink cartridge 8A in the head holder 50 is completed. On the other hand, the ink cartridge 8A can be removed from the head holder 50 by elastically deforming the pair of operation portions 63 inwardly from the base end portions thereof in the state where the ink cartridge 8A is mounted on the head holder 50, thereby releasing the engagement between the holding portions 63A and the hole portions 53, and then pulling up the ink cartridge 8A using the operation portions 63.

Figure 10:
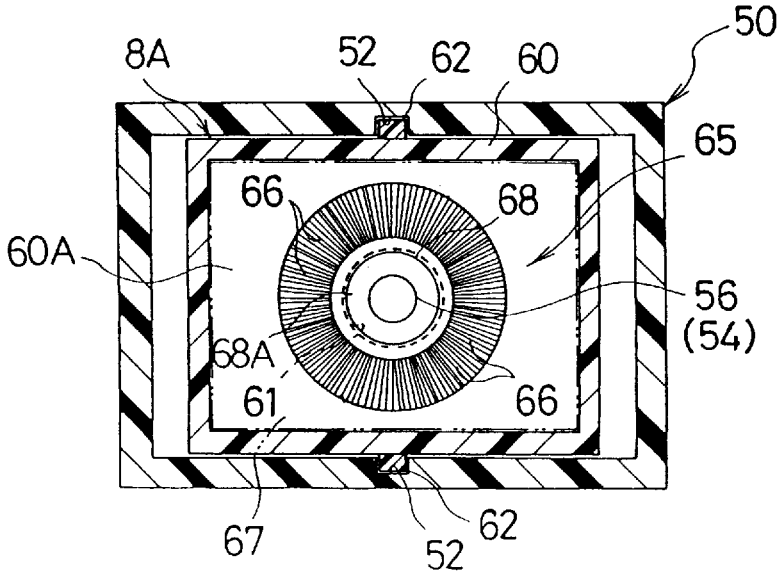
FIG. 10 is a cross-sectional view which is taken along an 10—10 line of FIG. 9.

As shown in FIGS. 9 to 11, the cartridge body 60 contains a capillary force generator 65. The ink which oozes or is forced from the ink absorber 67 during compression, when the ink supply member 54 is inserted, is returned into the ink absorber 67 by the capillary action. The capillary force generator 65 comprises a plurality of radial grooves extending radially from the peripheral portion of the ink supply port 61 to a portion adjacent to the ink absorber 67 on the bottom wall portion 60A in which the ink supply port 61 is opened.

When the ink cartridge 8A is mounted on the head holder 50, the gap between the inner peripheral surface of the seal member 68 and the shaft portion 56 of the ink supply member 54 is sealed by the pair of seal portions 68A of the seal member 68, as shown in FIG. 9. In this case, the upper seal portion 68A is elastically deformed in an upwardly curved shape (substantially like a mountain) through the insertion of the ink supply member 54, so that the ink which oozes from the ink absorber 67 due to the compression of the ink absorber 67 is trapped in a space Y which is produced through the compression of the ink absorber 67 and is located at the lower side from the upper end portion of the upper seal portion 68A. However, the trapped ink is guided back to the ink absorber 67 by the capillary force generator 65, as shown in FIG. 11, so that substantially all the ink that oozes from the ink absorber 67 is reabsorbed by the ink absorber 67.

That is, according to the ink cartridge 8A of this embodiment, the capillary force generator 65, comprising the plurality of small grooves 66 is provided on the bottom wall portion 60A in which the ink supply port 61 of the cartridge body 60 is opened, so that the ink trapped in the space Y can be allowed to be reabsorbed from the whole portion adjacent to the capillary force generator 65 by the ink absorber 67. Therefore, the withdrawal efficiency of the oozed ink can be improved, and the ink leakage from the ink supply port 61 of the cartridge body 60 can be prevented when the ink cartridge 8A is mounted on or detached from the cartridge body 60.

Further, since the capillary force generator 65 comprises the plurality of small grooves 66 extending from the peripheral portion of the ink supply port 61 to the portion adjacent to the ink absorber 67 on the bottom wall portion 60A of the cartridge body 60, like in the first embodiment, the capillary force generator 65 has a simple structure, the ink cartridge 8A can be manufactured at a low price, and the capillary action of the capillary force generator 65 can be surely obtained.

In both the embodiments as described above, the capillary force generator 42,65 may be formed of not only small grooves, but also fine grooves which intercommunicate with one another through many uneven portions like a crimp.

What is claimed is:

1. An ink cartridge which is detachably mounted on a head holder having an ink supply member which projects from the head holder and serves to supply ink to a recording head, comprising:

a cartridge body containing an ink absorber in which the ink is absorbed;

an ink supply port which is provided to the cartridge body and through which a tip portion of the ink supply member is inserted to supply the ink of said ink absorber to the ink supply member; and a capillary force generator which is provided in the cartridge body and serves to guide the ink that oozes from said ink absorber, and collects in an open space created when said ink absorber is compressed by the insertion of the ink supply member, to said ink absorber by capillary action to be reabsorbed by said ink absorber.

2. The ink cartridge as claimed in claim 1, wherein said capillary force generator is formed in an area extending from the ink supply port side to a portion adjacent to said ink absorber on a bottom wall portion of the cartridge body.

3. The ink cartridge as claimed in claim 1, wherein said ink supply port is formed on a side wall portion of the cartridge body, and said capillary force generator is formed in an area extending from the lower end portion of the side wall portion to the portion adjacent to said ink absorber on the bottom wall portion of the cartridge body.

4. The ink cartridge as claimed in claim 1, wherein said capillary force generator comprises a plurality of small grooves extending from the ink supply port side to the portion adjacent to said ink absorber.

5. An ink cartridge for detachably mounting to a carriage having a print head with an ink supply member having a tip end, the ink cartridge, comprising:

a cartridge body having an ink supply port;

an ink absorber within the cartridge body for retaining a liquid ink; and a capillary force generator on an inner surface of the cartridge body, wherein insertion of the tip end of the ink supply member into the ink supply port causes a compression of the ink absorber to create an open area where the liquid ink collects, the capillary force generator extending from the open area where the liquid ink collects into an area where the ink absorber remains in contact with the cartridge body to thereby return the liquid ink to the ink absorber.

6. The ink cartridge as claimed in claim 5, wherein the carriage mounts the ink cartridge at an angle such that the liquid ink collects at an internal intersection of two walls of the cartridge body, the capillary force generation extending from the intersection to the area where the ink absorber remains in contact with the cartridge body along a bottom wall of the intersecting two walls.

7. The ink cartridge as claimed in claim 6, wherein the capillary force generator comprises a plurality of parallel ribs having capillary grooves therebetween.

8. The ink cartridge as claimed in claim 6, wherein the capillary force generator is a plurality of grooves cut into the bottom wall.

9. The ink cartridge as claimed in claim 8, wherein the plurality of grooves are a plurality of parallel grooves.

10. The ink cartridge as claimed in claim 8, wherein the plurality of grooves extend from the intersection to where contact occurs between the ink absorber and the cartridge body.

11. The ink cartridge as claimed in claim 8, wherein the supply port is in the other wall of the intersecting two walls.

12. The ink cartridge as claimed in claim 5, wherein the carriage mounts the ink cartridge parallel to a print medium and above the print medium, the tip end of the ink supply member inserted into the ink supply port located in a wall facing the print medium.

13. The ink cartridge as claimed in claim 12, wherein the print medium is fed horizontally and the tip end of the ink supply member extends substantially vertically such that the liquid ink collects in an area around the tip end, the capillary force generator extending from adjacent the tip end to where the ink absorber is in contact with the wall.

14. The ink cartridge as claimed in claim 13, wherein the capillary force generator comprises a plurality of radial walls extending from the ink supply port with capillary grooves therebetween.

15. The ink cartridge as claimed in claim 13, wherein the capillary force generator comprises a plurality of grooves cut in the wall around the ink supply port.

16. The ink cartridge as claimed in claim 15 wherein the grooves are radial and extend from the ink supply port.

17. The ink cartridge as claimed in claim 15, wherein the plurality of grooves extend from the ink supply port in a generally radial direction.

* * * * *